US009986608B2

(12) United States Patent
Raniero et al.

(10) Patent No.: US 9,986,608 B2
(45) Date of Patent: May 29, 2018

(54) LIGHTING SYSTEM AND RELATED METHOD OF OPERATING A LIGHTING SYSTEM

(71) Applicant: OSRAM GmbH, Munich (DE)

(72) Inventors: Enrico Raniero, Codiverno di Vigonza (IT); Francesco Angelin, Mogliano Veneto (IT)

(73) Assignee: OSRAM GmbH, Munich (DE)

( * ) Notice: Subject to any disclaimer, the term of this patent is extended or adjusted under 35 U.S.C. 154(b) by 0 days. days.

(21) Appl. No.: 15/659,666

(22) Filed: Jul. 26, 2017

(65) Prior Publication Data

US 2018/0035502 A1 Feb. 1, 2018

(30) Foreign Application Priority Data

Aug. 1, 2016 (IT) ..... 102016000080749

(51) Int. Cl.
*H05B 33/00* (2006.01)
*H05B 33/08* (2006.01)

(52) U.S. Cl.
CPC ..... *H05B 33/0827* (2013.01); *H05B 33/0833* (2013.01); *H05B 33/0848* (2013.01)

(58) Field of Classification Search
CPC ..... H02M 1/14; H02M 1/42; H02M 1/44; H02M 2001/0003; H02M 2001/0058; H02M 2007/4811; H02M 2007/4815; H02M 2007/4822; H02M 3/1584; H02M 3/33584; H02M 3/33592; H02M 7/537; H02M 2001/0035
See application file for complete search history.

(56) References Cited

U.S. PATENT DOCUMENTS

2014/0300274 A1* 10/2014 Acatrinei ..... H05B 33/0815 315/85

FOREIGN PATENT DOCUMENTS

| | | | |
|---|---|---|---|
| DE | 102006005521 | B3 | 5/2007 |
| EP | 3013122 | A2 | 4/2016 |
| GB | 2434929 | A | 8/2007 |
| WO | 03032689 | A1 | 4/2003 |
| WO | 2009116854 | A2 | 9/2009 |

OTHER PUBLICATIONS

Italian Search Report based on application No. 102016000080749 (9 pages) dated May 22, 2017 (for reference purpose only).

* cited by examiner

*Primary Examiner* — Monica C King
(74) *Attorney, Agent, or Firm* — Viering Jentschura & Partner MBB

(57) ABSTRACT

The lighting system includes a voltage source for generating a constant direct current adapted to supply lighting modules, a number n of electronic switches, a current sensor connected in series with the voltage source to detect a measurement signal indicative of the current provided by the voltage source, and a control unit. The control unit generates the drive signals for the electronic switches. It varies the drive signals, such that: in a first instant, all lighting modules are connected to the voltage source; and during a sequence of instants, each time a different set of lighting modules is connected to the voltage source. It then determines the current flowing through all lighting modules as a function of the measurement signal detected in the first instant, and determines the currents which flow through the various lighting modules as a function of the measurement signals detected during the sequence of instants.

11 Claims, 8 Drawing Sheets

LIGHTING SYSTEM AND RELATED METHOD OF OPERATING A LIGHTING SYSTEM

CROSS-REFERENCE TO RELATED APPLICATIONS

This application claims priority to Italian Patent Application Serial No. 102016000080749, which was filed Aug. 1, 2016, and is incorporated herein by reference in its entirety.

TECHNICAL FIELD

The description relates to lighting systems.

BACKGROUND

FIG. 1 shows a typical lighting system. The lighting system includes a voltage source/voltage generator 12, configured to generate a constant direct voltage $V_{out}$, such as e.g. 12 VCC or 24 VCC, between a positive terminal 106 and a ground terminal GND. Therefore, the voltage source 12 may be a battery or an electronic converter (e.g. a switching supply AC/DC or DC/DC), e.g. supplied by the mains.

In the presently considered example, a plurality of lighting modules 20*a* . . . 20*n* are connected in parallel between line 106 and ground GND. Therefore, the lighting modules 20*a* . . . 20*n* are all supplied with the voltage $V_{out}$.

SUMMARY

Various embodiments of the present specification aim at providing a lighting system which is adapted to monitor the operation of the lighting modules connected to a voltage source.

According to various embodiments, said object is achieved thanks to a lighting system having the features set forth in the claims that follow. The claims also concern a corresponding method of operating a lighting system.

The claims are an integral part of the technical teaching provided herein with reference to the present disclosure.

As mentioned in the foregoing, the present description relates to a lighting system.

In various embodiments, the system includes a voltage source adapted to generate a constant direct voltage, adapted to supply a plurality of lighting modules.

In various embodiments, the system includes a number n of electronic switches, wherein each electronic switch is configured to connect a respective lighting module to the voltage source as a function of a respective drive signal. For example, in various embodiments, the voltage source includes a positive terminal and a negative terminal, wherein each lighting module is connected on one side to the positive terminal and on the other side, through a respective electronic switch, to the negative terminal.

In various embodiments, the system includes a current sensor, such as a shunt resistor, connected in series with the voltage source, so as to detect a measurement signal indicative of the current supplied to the voltage source. For example, in various embodiments, the current sensor is connected between the negative terminal of the voltage source and the electronic switches.

In various embodiments, the system includes a control unit, designed to generate the drive signals. For example, in various embodiments the drive signals are pulse-width-modulation signals having a given period and a given switch-on duration. For example, in various embodiments, the control unit determines the switch-on duration of each drive signal as a function of one or more control signals, e.g. in order to perform a colour correction and/or a dimming function.

In various embodiments, the control unit varies, advantageously only temporarily, the drive signals so that:

- in a first instant, all lighting modules are connected to the voltage source; and
- during a sequence of (n−1) instants, every time a different set of modules is connected to the voltage source.

For example, in various embodiments, the control unit may vary the drive signals during the sequence of instants, so that every drive signal is high/low in a given instant, while all other drive signals are low/high in the same given instant.

For example, in various embodiments, the period is the same for all drive signals. In this case, the control unit may vary the drive signals by delaying one or more drive signals, and/or by modifying the switch-on duration of one or more said drive signals.

In various embodiments, the control unit estimates the current flowing through all lighting modules as a function of the measurement signal detected in the first instant, and estimates the currents flowing through the single lighting modules as a function of the measurement signals detected during the sequence of instants.

For example, the control unit may determine a signal indicative of the (instantaneous) power absorbed as a function of the current flowing through all the lighting modules, and may determine one or more signals indicative of an error/failure as a function of the currents flowing through the single lighting modules.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the disclosed embodiments. In the following description, various embodiments described with reference to the following drawings, in which.

DETAILED DESCRIPTION

In the following description, numerous specific details are given to provide a thorough understanding of the embodiments. The embodiments can be practiced without one or more of the specific details, or with other methods, components, materials, etc. In other instances, well-known structures, materials, or operations are not shown or described in detail to avoid obscuring various aspects of the embodiments.

Reference throughout this specification to "one embodiment" or "an embodiment" means that a particular feature, structure, or characteristic described in connection with the embodiment is included in at least one embodiment. Thus, the possible appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

The headings provided herein are for convenience only and therefore do not interpret the extent of protection or meaning of the embodiments.

Figure 1:
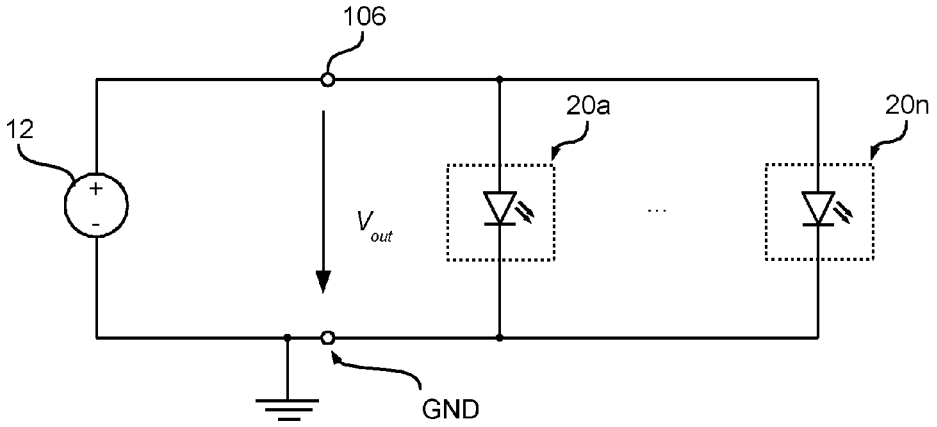
FIG. 1 has already been described in the foregoing.

As shown in FIG. 1, a lighting system may include a voltage source/voltage generator 12, configured to generate a constant direct voltage $V_{out}$, such as for instance 12 VCC or 24 VCC, between a positive terminal 106 and a ground terminal GND. Therefore, the voltage source 12 may be a battery or an electronic converter (e.g. a switching supply AC/DC or DC/DC), for example supplied by the mains.

A plurality of lighting modules 20*a* . . . 20*n* are connected in parallel between line 106 and ground GND. As a consequence, in the presently considered embodiment, the lighting modules 20*a* . . . 20*n* are all supplied with voltage $V_{out}$.

Generally speaking, each lighting module 20 includes one or more lighting sources. For example, FIG. 2 shows a lighting module 20 including at least one LED (Light Emitting Diode) L, or other solid-state lighting means. For instance, in the presently considered example, lighting module 20 includes a LED chain, i.e. a plurality of LEDs connected in series between line 106 and ground GND. For example, FIG. 2 shows three LEDs $L_1$, $L_2$ and $L_3$.

The person skilled in the art will appreciate that a LED (or a LED chain) is not supposed to be supplied directly with a constant voltage; an additional member must be provided to regulate or at least limit the current flowing through LED(s) L.

For instance, in the presently considered embodiment, lighting module 20 includes a resistor $R_{La}$ which is connected in series with LEDs $L_1$, $L_2$ and $L_3$ and which limits the current flowing through the LEDs L.

Figure 2A:
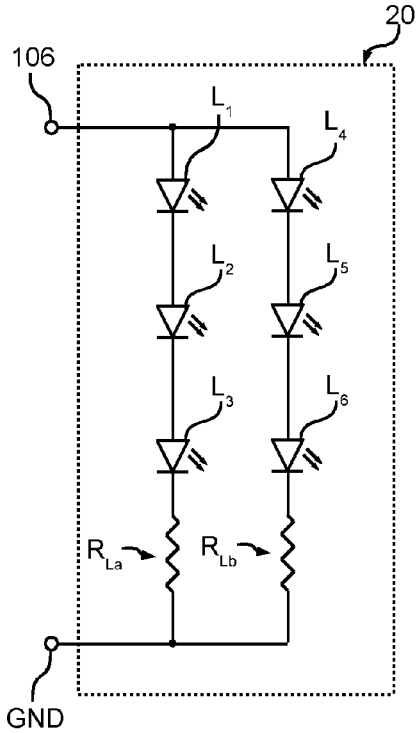
FIGS. 2A, 2B and 2C show embodiments of lighting modules according to the present description.

Generally speaking, lighting module 20 may also include a plurality of LED chains connected in parallel, as schematically shown in FIG. 2A, wherein lighting module 20 includes a second LED chain connected in parallel with the first LED chain, i.e. between terminals 106 and GND. For example, in the presently considered embodiment, the second chain includes three LEDs $L_4$, $L_5$ and $L_6$ with a respective current limiting resistor $R_{Lb}$.

Figure 2B:
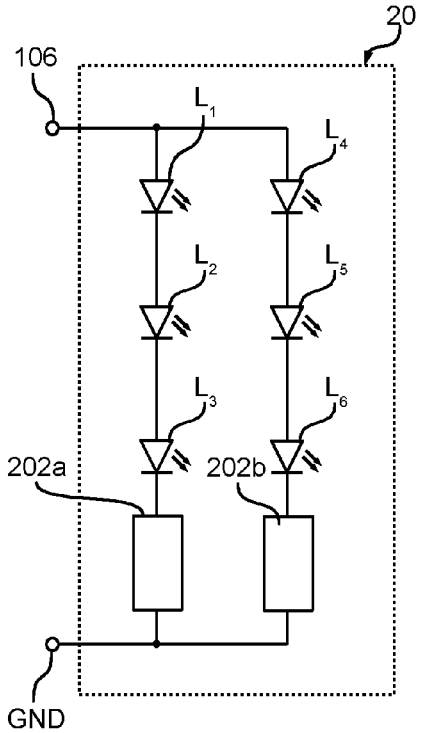

On the other hand, FIG. 2B shows an embodiment wherein resistors $R_{La}$ and $R_{Lb}$ shown in FIG. 2A have been replaced with current regulators or limiters 202*a* and 202*b* connected in series with the respective LED chain. Therefore, in the presently considered embodiment, one or more LED chains are again connected between terminals 106 and GND, and a current limiter is connected in series with each LED chain. For example, as known in the art, such a current limiter may be implemented e.g. with two bipolar transistors.

Figure 2C:
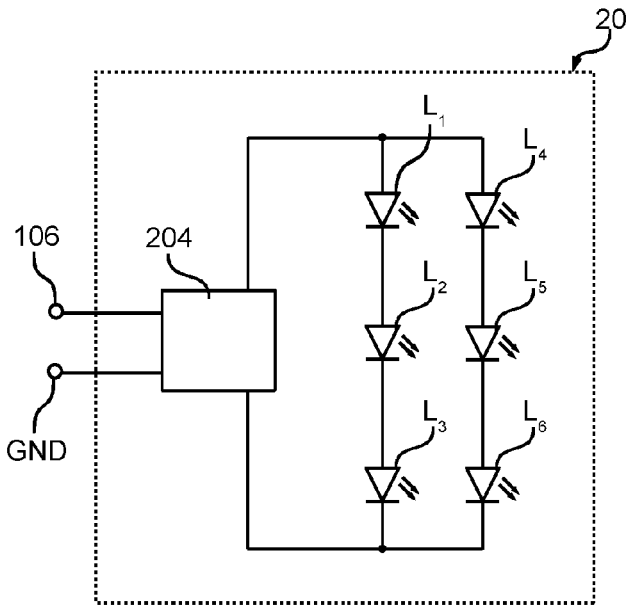

Finally, FIG. 2C shows an embodiment wherein lighting module 20 includes an electronic converter 204, such as e.g. a "buck", "boost", "buck-boost", "flyback" converter, etc., designed to receive a constant voltage through terminals 106 and GND and to provide, through both output terminals, a regulated current. Specifically, in this case, the LED chain(s) is/are connected in parallel at the output of electronic converter 204, which therefore enables the achievement of a correct supply of the LEDs. The person skilled in the art will appreciate that further components may be envisaged to better regulate the current flowing through the LED chains, e.g. because the LED chains may also have different requirements in supply voltage.

Generally speaking, the various lighting modules 20 shown in the FIGS. 2A to 2C may be combined within one and the same lighting system, e.g. by connecting different lighting modules 20 to the same voltage supply 12.

Therefore, generally speaking, each lighting module 20 is designed to be supplied with a constant voltage, and includes:

- two terminals 106 and GND for the connection to a voltage source 12, which supplies a substantially constant direct voltage;
- one or more LEDs L connected in series and/or in parallel, wherein typically one LED chain or a plurality of LED chains are connected in parallel between the terminals 206 and GND, wherein each LED chain includes one LED L or a plurality of LEDs L connected in series; and
- means for regulating or at least limiting the current flowing through the LED(s) of the respective lighting module 20, such as e.g. a resistor $R_L$ or a current limiter 202, connected in series with the LED(s) L of each LED chain, or an electronic converter 204 with current control.

Figure 3:
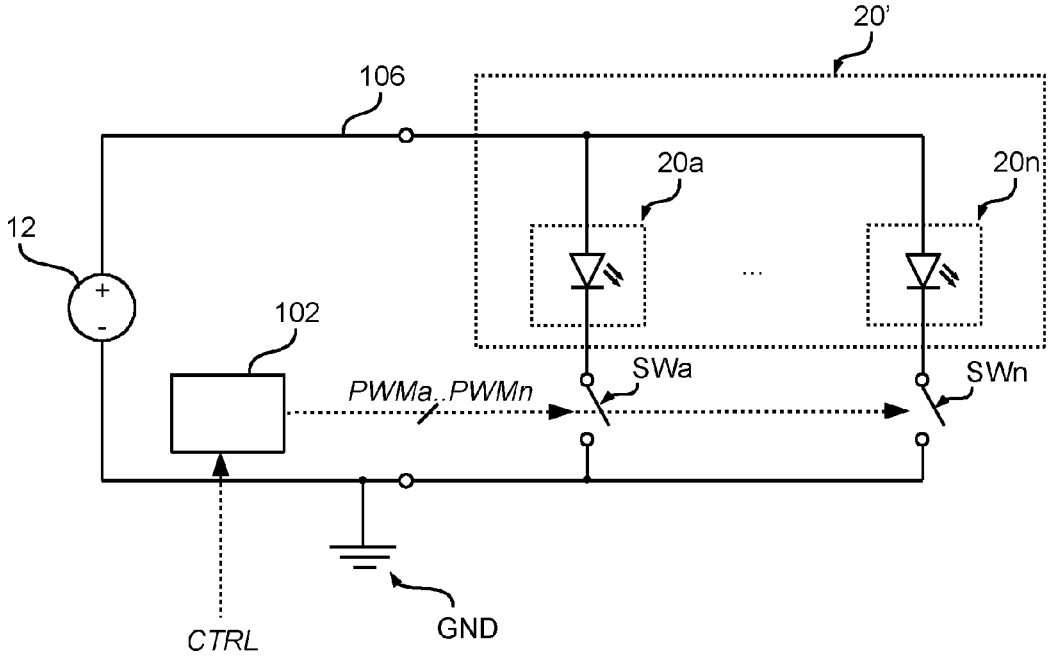
FIG. 3 shows a first embodiment of a lighting system according to the present specification.

FIG. 3 shows an embodiment of a lighting system including a plurality of lighting modules 20*a* . . . 20*n*. Generally speaking, such lighting modules 20*a* . . . 20*n* may be integrated into one and the same physical module 20', for example they may be mounted onto the same printed circuit.

Specifically, in the presently considered embodiment, the lighting system includes, for each lighting module 20*a* . . . 20*n*, an electronic switch SWa . . . SWn, such as e.g. a Field-Effect Transistor (FET), for example a MOSFET (Metal-Oxide-Semiconductor Field-Effect Transistor) such as e.g. an n-type MOSFET.

Specifically, each electronic switch SWa . . . SWn is configured for selectively activating or deactivating a respective lighting module 20*a* . . . 20*n*.

For example, in the presently considered embodiment, each electronic switch SWa . . . SWn and the respective lighting module 20*a* . . . 20*n* are connected in series between terminals 106 and GND. Therefore, if a plurality of modules 20*a* . . . 20*n* are included into the same physical module 20', said physical module 20' may include a first terminal for the connection to line 106 and, for each lighting module 20*a* . . . 20*n*, a respective terminal for the connection to a respective switch SWa . . . SWn.

In the presently considered embodiment, the electronic switches SWa . . . SWn are driven via respective drive signals PWMa . . . PW.Mn generated by a control unit 102 as a function of a control signal CRTL.

Figure 4:
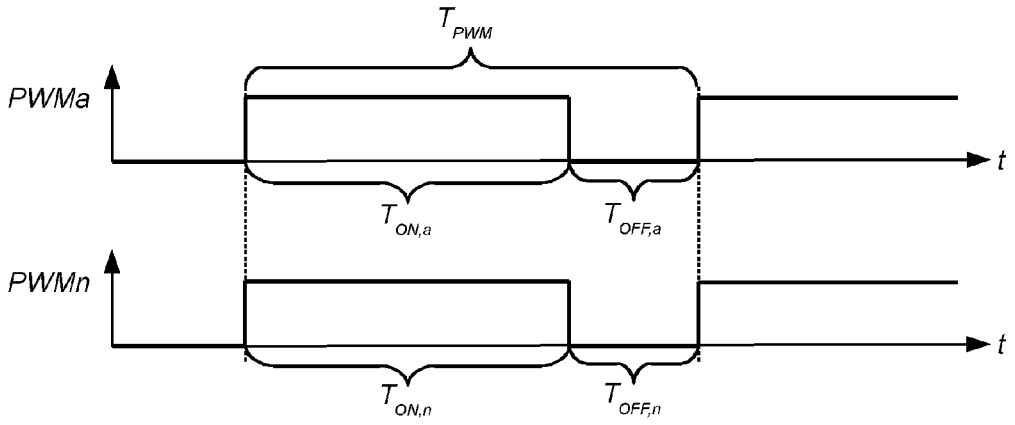
FIGS. 4, 5A and 5B show examples of drive signals adapted to be used in the lighting system of FIG. 3.

As shown in FIG. 4, in various embodiments each drive signal PWMa . . . PW.Mn corresponds to a Pulse-Width Modulation (PWM) signal.

Specifically, in various embodiments, all drive signals PWMa . . . PW.Mn have the same switching frequency $f_{PWM}$, i.e. the same switching period $T_{PWM}=1/f_{PWM}$. On the other hand, the switch-on durations $T_{ON,a}$ . . . $T_{ON,n}$ during which the signals PWMa . . . PW.Mn are high, and the switch-off durations $T_{OFF,a}$ . . . $T_{OFF,n}$ during which signals PWMa . . . PW.Mn are low may be different from each other (wherein $T_{PWM}=T_{ON}+T_{OFF}$ for each drive signal PWMa . . . PWMn), i.e. the duty cycle ($=T_{ON}/T_{PWM}$) may vary among the various drive signals PWMa . . . PW.Mn.

Figure 5A:
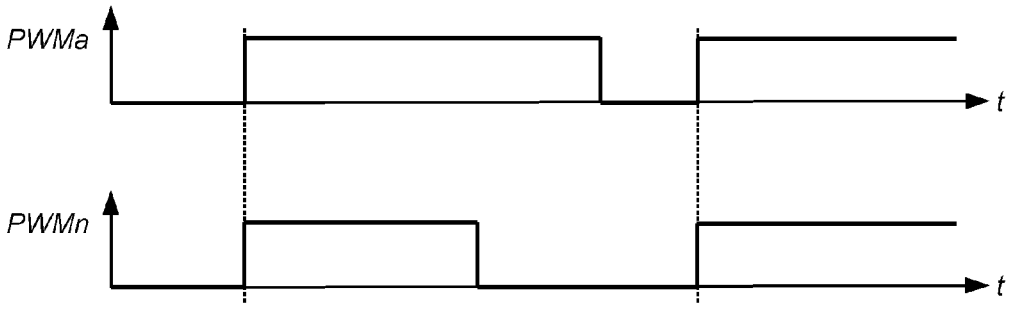

As shown in FIG. 5A, in various embodiments control unit 102 may change the duty cycle of one or more drive signals PWMa . . . PWMn in order to modify the brightness of certain lighting modules 20*a* . . . 20*n*.

For example, such a mechanism may be used in order to modify the colour of the total light emitted by a plurality of lighting modules 20*a* . . . 20*n*. In this case, the control signal CTRL may be indicative of the requested colour.

For example, in various embodiments, the lighting system includes at least two lighting modules 20 emitting light with two different spectral characteristics, for example:

- two lighting modules 20 emitting white light with different colour temperatures, e.g. warm light and cold light;
- three lighting modules emitting light in three different colours, such as red, green and blue;
- four lighting modules, wherein one main lighting module emits white light and the other three lighting modules provide a correction and emit light in three different colours, such as red, green and blue.

Figure 5B:
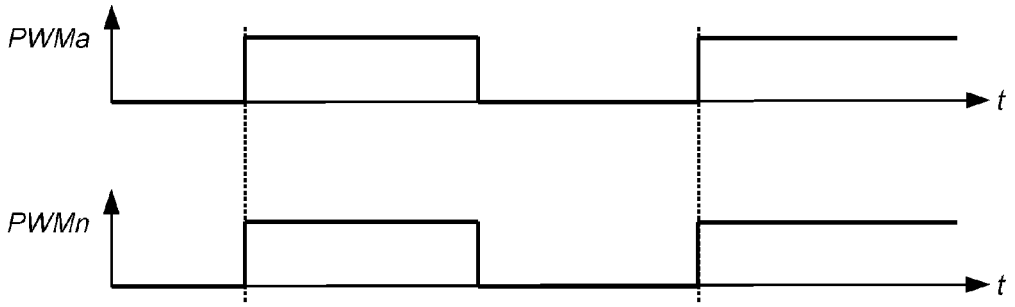

On the other hand, FIG. 5B shows an embodiment wherein the control unit 102 modifies the duty cycle of all drive signals PWMa . . . PWMn in order to regulate the brightness of the total light emitted simultaneously by all lighting modules 20*a* . . . 20*n*, so-called dimming function. In this case, control signal CTRL may be indicative for the required total brightness.

Generally speaking, the functions of colour correction and dimming may also be combined, i.e. the control unit 102 may vary the duty cycle of one or more, or even of all lighting modules, as a function of one or more control signals CTRL.

Therefore, in the presently considered embodiment, the functions of colour correction and/or dimming are based on the on and off switching of the lighting modules for given periods, while the regulation of the current flowing through each lighting module 20 is performed irrespective of the module itself, and only during the period when the module is on. For this reason, the switching frequency of the signals PWMa . . . PWMn should be higher than approximately 50 Hz, lest the human sight perceives flickerings or artifacts. Moreover, the switching frequency of signals PWMa . . . PWMn should be typically lower than 5 kHz, e.g. in order not to interfere with an electronic converter within the lighting module. For example, in various embodiments, the switching frequency of signals PWMa . . . PWMn may range from 100 Hz and 5 kHz, advantageously from 500 Hz to 2 kHz, for example 1 kHz.

In various embodiments, the drive signals are synchronized so that the various lighting modules are on at the same time. For example, as shown in FIG. 5A, if all pulses have the same duration $T_{ON}$, the pulses take place at the same time. On the contrary, as shown in FIG. 5B, if the pulses have different durations $T_{ON}$, the pulses with shorter duration take place anyway in parallel with the longer pulses.

For example, in the presently considered embodiments, this condition is guaranteed by the control unit 102, which synchronizes the instant of switching on lighting modules 20*a* . . . 20*n*, e.g. by switching on all lighting modules 20*a* . . . 20*n* simultaneously at the beginning of the PWM period, while the switch-on duration $T_{ON}$ may vary for the various lighting modules 20*a* . . . 20*n*. As an alternative, the control unit 102 may synchronize the moment of switching off the lighting modules 20*a* . . . 20*n*, i.e. it may switch off all lighting modules 20*a* . . . 20*n* simultaneously.

As a consequence, as explained in the foregoing, the control unit 102 and the switches SWa . . . SWn enable a periodical on-off switching of lighting modules 20*a* . . . 20*n*, while the current regulation for supplying the LEDs takes place independently within each lighting module 20*a* . . . 20*n*.

In various embodiments, the lighting system is configured to measure in any case the current flowing through each lighting module 20*a* . . . 20*n*. For example, in various embodiments, the measured current may be used to determine the energy consumption of the lighting modules 20*a* . . . 20*n* and/or to detect a failure/disconnection of one or more lighting modules 20*a* . . . 20*n*.

In various embodiments, a respective current sensor is used for each lighting module 20*a* . . . 20*n*, such as for example a respective resistor connected in series with each lighting module 20*a* . . . 20*n*.

This embodiment, however, has the drawback of requiring a plurality of current sensors and a corresponding number of measurement channels, e.g. a plurality of analog-to-digital converters.

Figure 6:
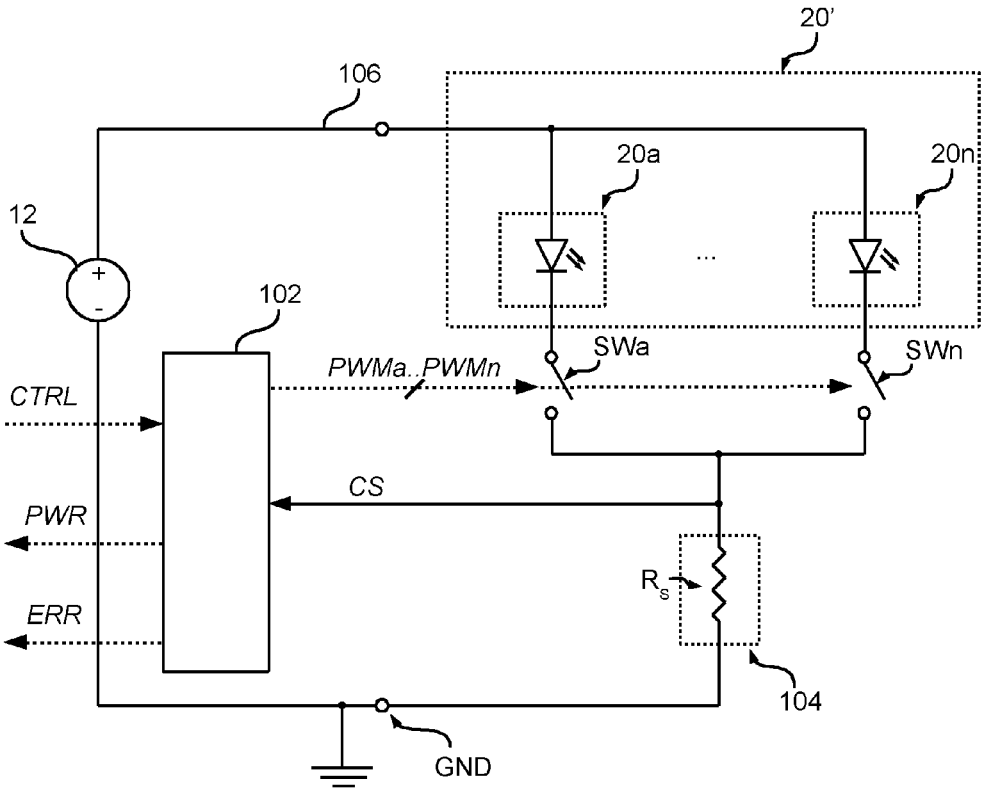
FIG. 6 shows a second embodiment of a lighting system according to the present specification.

On the other hand, FIG. 6 shows an embodiment of a lighting system including one single current sensor 104 for all the lighting modules 20*a* . . . 20*n*.

Specifically, in the presently considered embodiment, a current sensor 104 such as a resistor, a current sensor based on a current mirror etc. is interposed in the supply line 106 or advantageously in the ground line GND, connecting the lighting modules 20*a* . . . 20*n* to voltage source 12; in other words, the current sensor 104 is connected in series with voltage source 12.

Specifically, in the presently considered embodiment, current sensor 104 is connected on one side (e.g. directly) to ground GND of voltage source 12, and is connected on the other side (e.g. directly) to each switch SWa . . . SWn.

For example, in the presently considered embodiment, current sensor 104 is a shunt resistor $R_S$, i.e. a resistor having a low resistance, e.g. between 10 mOhm and 100 Ohm. In this case, the current flowing through resistor $R_S$ generates a voltage drop which may be measured e.g. via a line CS which is connected at the middle point between resistor $R_S$ and switches SWa . . . SWn. Therefore, the signal on this line CS, e.g. the voltage referred to ground GND, is indicative of the current flowing through current sensor 104/resistor $R_S$.

In the presently considered embodiment, line CS is also connected to control unit 102, which therefore is adapted to detect, e.g. via an analog-to-digital converter, the current flowing through current sensor 104/resistor $R_S$.

Therefore, in the presently considered embodiment, the sensed current is indicative of the total current flowing through lighting modules 20*a* . . . 20*n*, which are currently accessed via the respective switch SWa . . . SWn.

Consequently, in the instants when all lighting modules 20*a* . . . 20*n* are on, i.e. all lighting modules 20*a* . . . 20*n* are connected between line 106 and current sensor 104, the signal on line CS indicates the total current flowing through all lighting modules 20*a* . . . 20*n*. For example, in various embodiments, control unit 102 is designed to make use of such total current in order to determine a PWR signal indicative of the instantaneous total electrical power absorbed by all lighting modules 20*a* . . . 20*n*.

On the other hand, when only one switch SWa . . . SWn is closed, the signal on line CS will only indicate the current flowing through the respective lighting module 20*a* . . . 20*n* which is connected between line 106 and current sensor CS.

Such a behaviour may therefore be used by control unit 102 in order to adjust, if necessary, the drive signals PWMa . . . PWMn described with reference to FIGS. 4, 5A and 5B, so that during one or more PWM cycles each lighting module 20*a* . . . 20*n* is temporarily connected as one single lighting module 20*a* . . . 20*n* in series with current sensor CS.

Specifically, in various embodiments, control unit 102 determines, as previously described, the drive signals PWMa . . . PWMn as a function of one or more control signals CTRL, wherein said drive signals PWMa . . . PWMn represent required or reference signals. Subsequently, control unit 102 temporarily modifies, e.g. only during certain PWM cycles, said drive signals PWMa . . . PWMn so as to enable a current measurement of each lighting module 20*a* . . . 20*n*.

Some possible embodiments of the generation and/or adjustment of drive signals PWMa . . . PWMn will be described in the following.

Figure 7A:
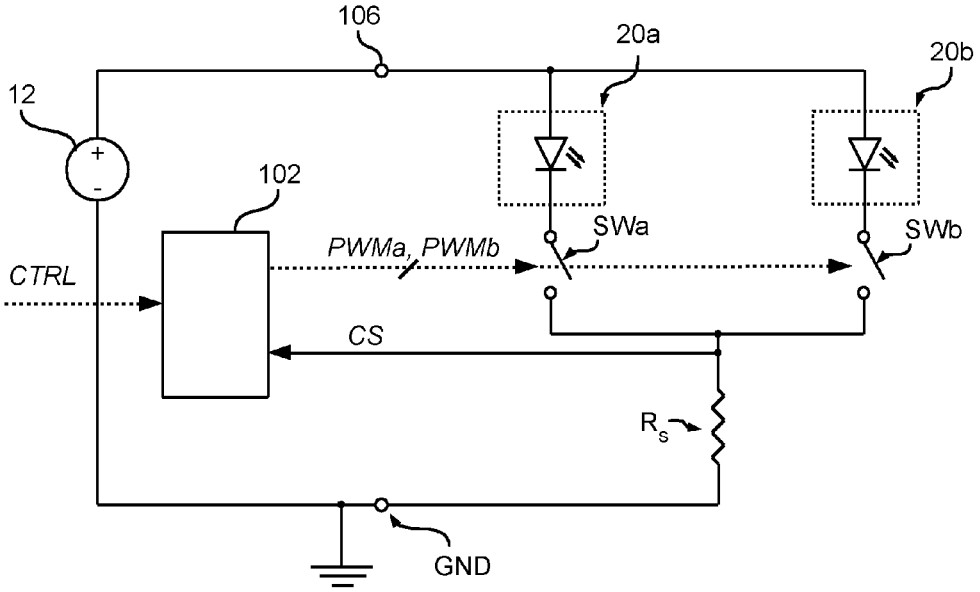
FIG. 7A shows a third embodiment of a lighting system according to the present specification.

For example, FIG. 7A shows an embodiment of a lighting system wherein two lighting modules 20*a* and 20*b* may be connected to voltage source 12, and therefore there are provided two electronic switches SWa and SWb, and the control unit 102 is configured to generate two respective drive signals PWMa and PWMb.

Figure 7B:
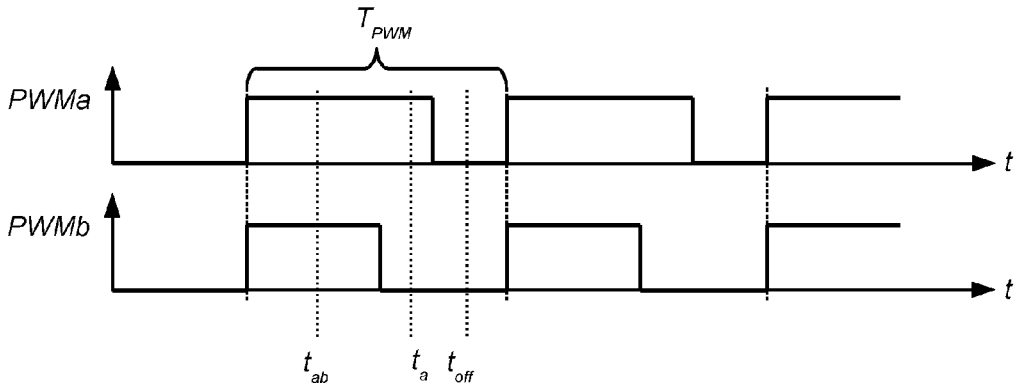
FIGS. 7B, 7C, 7D and 7E show examples of drive signals which may be used in the lighting system of FIG. 7A.

FIG. 7B shows a first embodiment of drive signals PWMa and PWMb. Specifically, in the presently considered embodiment, signals PWMa and PWMb substantially correspond to the signals already shown in FIG. 5A, wherein the drive signals have different durations, e.g. the drive signals PWMa and PWMb are switched on simultaneously, but they are switched off at different times. For example, in the presently considered embodiment, the switch-on time of drive signal PWMa is longer than the switch-on time of drive signal PWMb.

Therefore, in this case, control unit 102 may determine the total current flowing through both lighting modules, by measuring the signal on line CS while both signals PWMa and PWMb are high, e.g. in an instant $t_{ab}$. Generally speaking, control unit 102 may measure the instantaneous total current for each PWM cycle or periodically.

On the other hand, the control unit 102 may determine the current flowing only through module 20*a*, by measuring the signal on line CS, while signal PWMa is high and signal PWMb is low, e.g. at a time $t_b$.

However, in the presently considered embodiment, there is no instant when only lighting module 20*b* is on. Nevertheless, control unit 102 may in any case determine the current flowing only through module 20*b*, by subtracting the current flowing only through module 20*a* from the total current.

Therefore, generally speaking, in order to determine the current flowing through a number n of lighting modules, the control unit performs, at least:

a measurement wherein all lighting modules are on, and (n−1) measurements wherein every time one different lighting module is on or one different lighting module is off.

The current of the last (i.e. of the n-th) lighting module may therefore be calculated from the other measurements, or a new measurement may be carried out.

The inventors have observed that it is in any case convenient to perform all measurements, because in this way the control unit 102 may verify whether the sum of the measures for the single lighting modules corresponds to the measure for all lighting modules, and optionally it may generate an error if data do not match.

In various embodiments, control unit 102 may also check if the current measured on line CS is equal to zero while all drive signals are low, e.g. at a time $t_{off}$.

For example, in this way the control unit may detect a possible failure of an electronic switch SW, and it may optionally generate an error signal ERR.

On the contrary, if the drive signals PWMa and PWMb have the same switch-on duration (see for example FIG. 5B), there would be no instant when only one of the lighting modules 20*a* and 20*b* is on. For this reason, control unit 102 may modify (optionally only temporarily) the drive signals PWMa and/or PWMb.

Figure 7C:
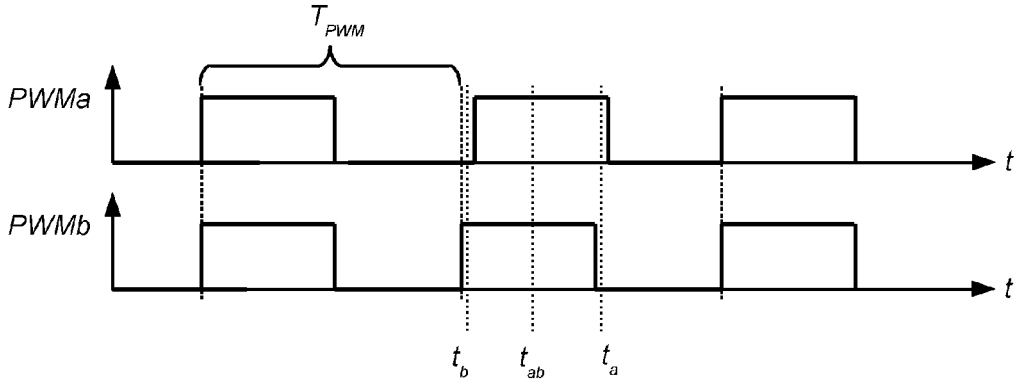

For example, FIG. 7C shoes an embodiment wherein drive signals PWMa and PWMb have the same switch-on duration. However, control unit 102 is designed to delay one of the drive signals PWMa and PWMb. For example, in the presently considered embodiment, control unit 102 delays the drive signal PWMa during the second PWM cycle. Generally speaking, the drive signal PWMa might even be delayed for all PWM cycles.

This embodiment is therefore adapted to keep the ratio between $T_{ON}$ and $T_{OFF}$, and therefore the brightness, constant. Indeed, as can be seen in FIG. 7C, the absolute switch-on time $T_{on}$ remains constant within time period $T_{pwm}$.

Therefore, thanks to the (optionally only temporary) phase shift of the drive signals PWMa and PWMb, there are now instants when:

both drive signals PWMa and PWMb are high, e.g. at time $t_{ab}$;

only the drive signal PWMa is high, e.g. at time $t_a$; and only the drive signal PWMb is high, e.g. at time $t_b$.

Figure 7D:
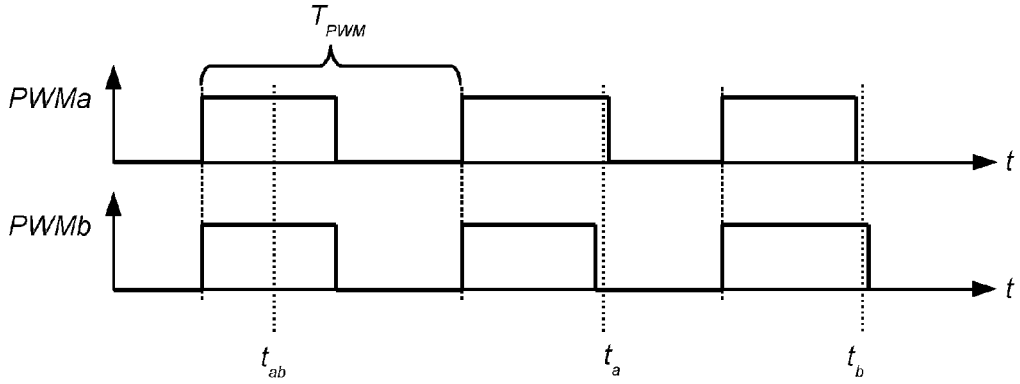

FIG. 7D shows a second embodiment, wherein the drive signals PWMa and PWMb have the same switch-on duration. In this case, control unit 102 is configured to temporarily modify the duration of one of the drive signals PWMa and PWMb (i.e. to lengthen or shorten the switch-on time). For example, in the presently considered embodiment, control unit 102 lengthens the duration of the drive signal PWMa during the second PWM cycle, and lengthens the duration of the drive signal PWMb during the third PWM cycle. Therefore, thanks to the modification of the switch-on time of the drive signals PWMa and PWMb, there are instants when:

both drive signals PWMa and PWMb are high, e.g. at time $t_{ab}$;

only the drive signal PWMa is high, e.g. at time $t_a$; and only the drive signal PWMb is high, e.g. at time $t_b$.

Therefore, in the presently considered embodiment, the switch-on time $T_{ON}$ is lengthened to carry out the measurement (instants $t_a$ and $t_b$ of FIG. 7D) thereby bringing about a change in the duty cycle and therefore in the brightness. In this case, at low dimming levels, the measurement may be visible.

As previously stated, the lighting systems described in the foregoing are based on the use of PWM drive signals. However, these signals are normally used for colour correction and/or dimming. Therefore, situations may arise wherein one or more of the drive signals have a duty cycle of 100%.

In this case, which is similar to the embodiment described with reference to FIG. 7D, control unit 102 may modify (advantageously only temporarily) the switch-on time, specifically by reducing the duty cycle.

Figure 7E:
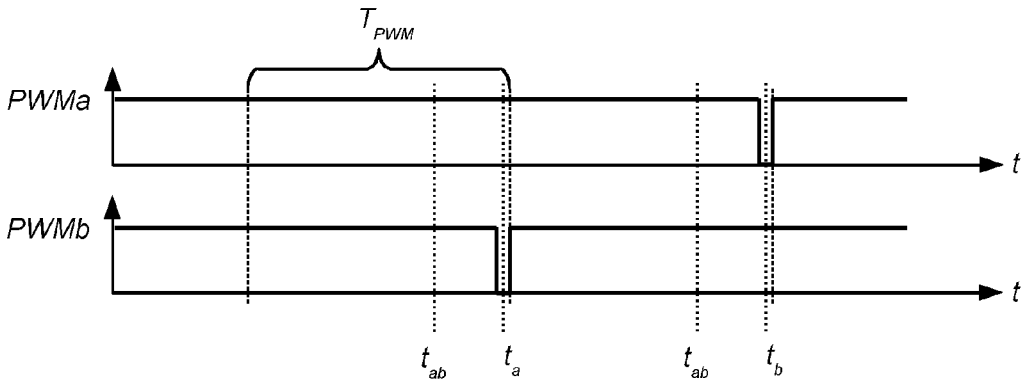

For example, as shown in FIG. 7E, control unit 102 may reduce the duty cycle of the drive signal PWMb during a first PWM cycle, and reduce the duty cycle of the drive signal PWMa during a second PWM cycle. In this way, we find again instants when:

both drive signals PWMa and PWMb are high, e.g. at time $t_{ab}$;

only the drive signal PWMa is high, e.g. at time $t_a$; and only the drive signal PWMb is high, e.g. at time $t_b$.

Generally speaking, the procedures of delaying/phase-shifting or modifying the PWM drive signals may be combined. As previously stated, advantageously the variation is only temporary, i.e. the control unit is designed to directly use the reference PWM drive signals that have been determined as a function of one or more control signals CTRL during the other PWM cycles.

Moreover, the procedures of delaying/phase-shifting or modifying the PWM drive signals may be applied to a higher number of lighting modules.

Figure 8A:
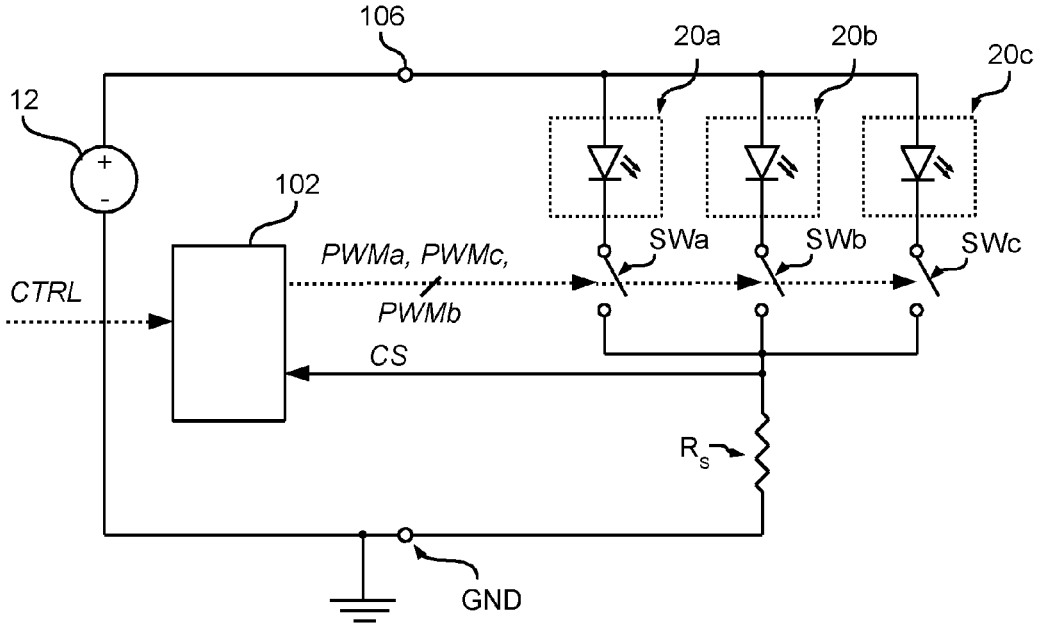
FIG. 8A shows a fourth embodiment of a lighting system according to the present specification.

For example, FIG. 8A shows an embodiment of a lighting system wherein three lighting modules 20*a*, 20*b* and 20*c* may be connected to the voltage source 12, and therefore there are provided three electronic switches SWa, SWb and SWc, and control unit 102 is configured to generate three respective drive signals PWMa, PWMb and PWMc.

Figure 8B:
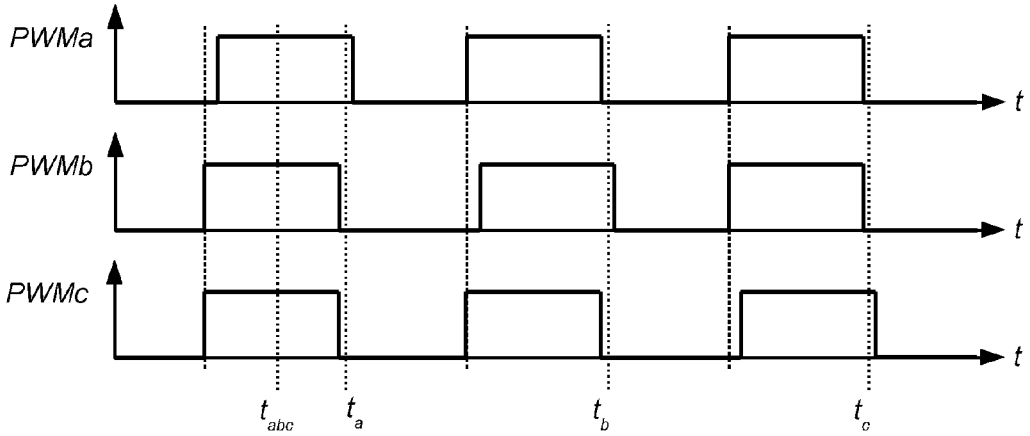
FIGS. 8B to 8G show examples of drive signals which may be used in the lighting system of FIG. 8A.

For example, FIG. 8B shows an embodiment wherein the drive signals PWMa, PWMb and PWMc have the same switch-on duration. However, control unit 102 is configured to delay, in certain PWM cycles, one of the drive signals PWMa, PWMb and PWMc. For example, in the presently considered embodiment, control unit 102 delays the drive signal PWMa during the first PWM cycle, delays the drive signal PWMb during the second PWM cycle and delays the drive signal PWMc during the first PWM cycle.

Therefore, thanks to the temporary phase shift of the drive signals PWMa, PWMb and PWMc there are instants when:

all the drive signals PWMa, PWMb and PWMc are high, e.g. at time $t_{abc}$, which enables to measure the total current flowing through all lighting modules 20*a*, 20*b* and 20*c;* only the drive signal PWMa is high, e.g. at time $t_a$, which enables to measure the current flowing only through lighting module 20*a;* only the drive signal PWMb is high, e.g. at time $t_b$, which enables to measure the current flowing only through lighting module 20*b*; and only the drive signal PWMc is high, e.g. at time t, which enables to measure the current flowing only through lighting module 20*c*.

Also in this case it is sufficient to delay only (n−1), i.e. two, PWM drive signals, and the current for the last lighting module may be calculated on the basis of the other measurements.

Figure 8C:
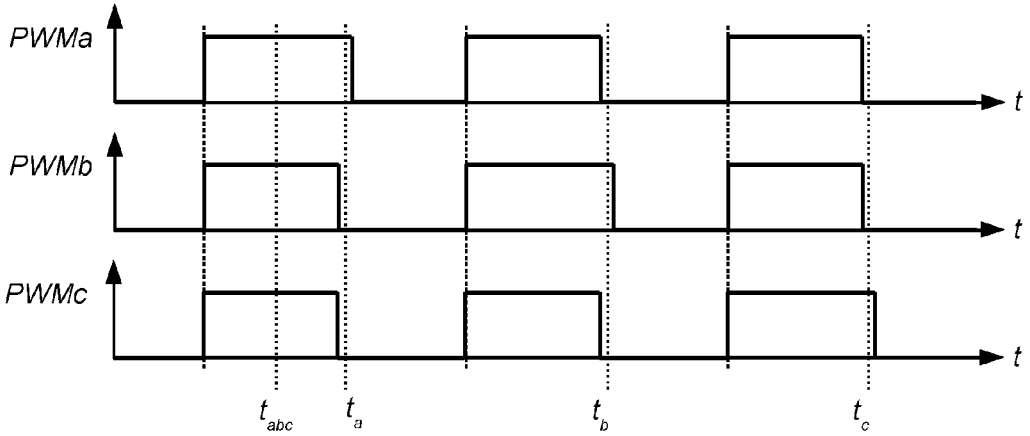

On the other hand, FIG. 8C shows an embodiment wherein control unit 102 is designed to temporarily modify, in given PWM cycles, the duration of one of the drive signals PWMa, PWMb and PWMc (specifically, to lengthen the switch-on time). For example, in the presently considered embodiment, control unit 102 lengthens the duration of drive signal PWMa during the first PWM cycle, lengthens the duration of drive signal PWMb during the second PWM cycle and lengthens the duration of drive signal PWMc during the second PWM cycle. Therefore, thanks to the modification of the switch-on time of drive signals PWMa, PWMb and PWMc there are again instants when:

all drive signals PWMa, PWMb and PWMc are high, e.g. at time $t_{abc}$, which enables to measure the total current flowing through all lighting modules 20*a*, 20*b* and 20*c;* only the drive signal PWMa is high, e.g. at time $t_a$, which enables to measure the current flowing only through lighting module 20*a;* only the drive signal PWMb is high, e.g. at time $t_b$, which enables to measure the current flowing only through lighting module 20*b*; and only the drive signal PWMc is high, e.g. at instant $t_c$, which enables to measure the current flowing only through lighting module 20*c*.

Generally speaking, also in this case control unit 102 may combine both embodiments.

Figure 8D:
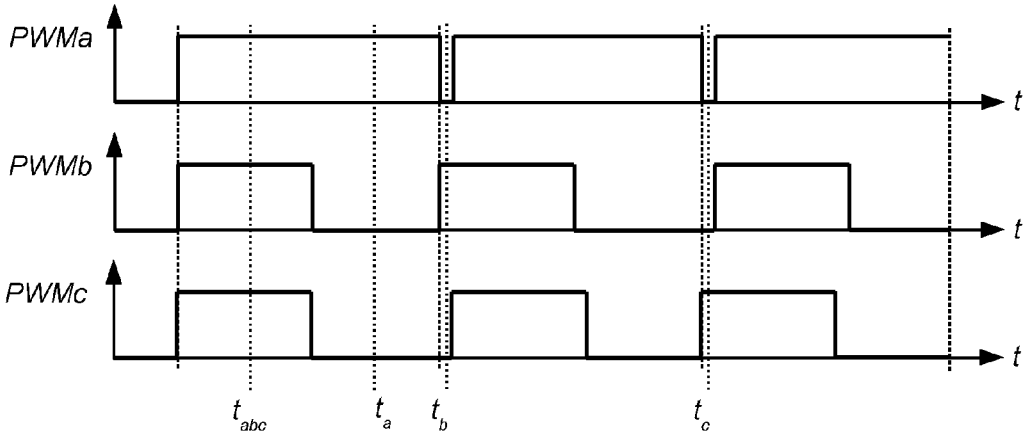

For example, FIG. 8D shows an embodiment wherein drive signal PWMa has a duty cycle of 100% and the drive signals PWMb and PWMc have the same duty cycle, e.g. substantially of 50%.

In this case, the control unit 102 may be configured to temporarily modify, in given PWM cycles, the duration of drive signal PWMa (specifically, to shorten the switch-on time). Moreover, control unit 102 may temporarily delay, in given PWM cycles, one of the drive signals PWMb or PWMc, so as to ensure the presence of instants when:

all drive signals PWMa, PWMb and PWMc are high, e.g. at time $t_{abc}$;

only drive signal PWMa is high;

only drive signal PWMb is high; and only drive signal PWMc is high.

As stated in the foregoing, instead of switching on a single lighting module, it is also envisageable to calculate the current of a given lighting module by switching that single lighting module off.

Figure 8E:
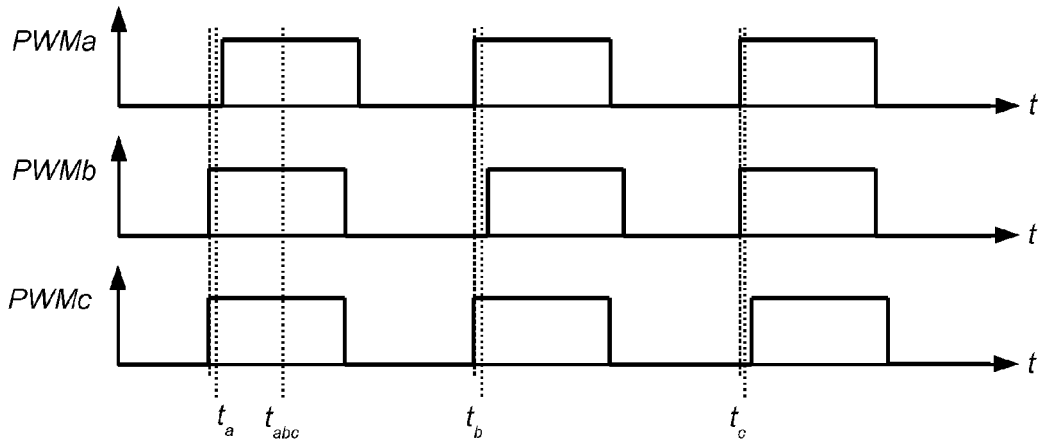

For example, FIG. 8E shows an embodiment which makes use of the drive signals PWMa, PWMb and PWMc shown in FIG. 8B, but the instants of the current measurements are different. Specifically, thanks to phase shifting there are instants when:

all drive signals PWMa, PWMb and PWMc are high, e.g. at time $t_{abc}$ which enables to measure the total current flowing through all lighting modules 20*a*, 20*b* and 20*c;* only the drive signal PWMa is low, e.g. at time $t_a$, which enables calculating the current flowing only through lighting module 20*a;* only drive signal PWMb is low, e.g. at time $t_b$, which enables calculating the current flowing only through lighting module 20*b*; and only drive signal PWMc is low, e.g. at time $t_c$, which enables calculating the current flowing only through lighting module 20*c*.

Figure 8F:
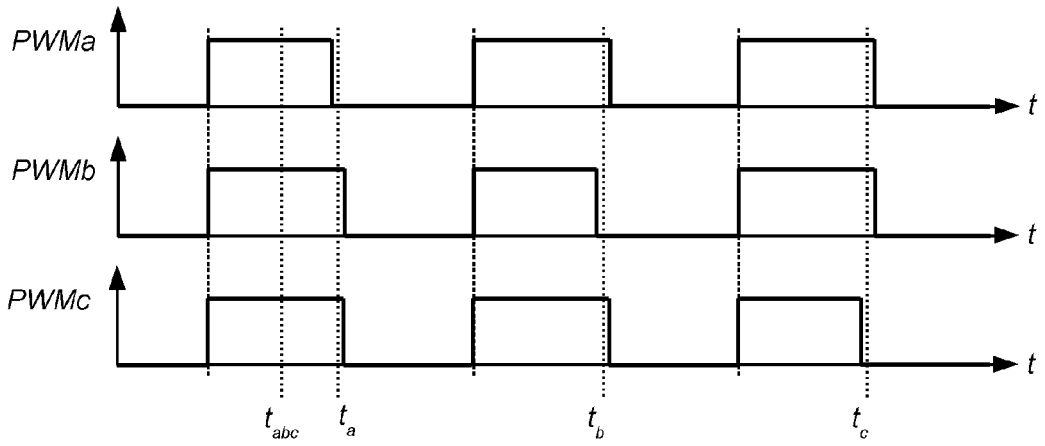

FIG. 8F shows an embodiment substantially corresponding to FIG. 8C, the difference consisting in a reduction of the switch-on times $T_{ON}$; in other words, there are instants when each time only one lighting module is off.

The person skilled in the art will appreciate that various embodiments may also be combined with each other. Therefore, in general, control unit 102 is configured to modify the drive signals so that during a sequence of (n−1) instants, each time a different set of lighting modules (20*a* . . . 20*n*) is connected to the voltage source 12. For example, in various embodiments the control unit 102 may either switch on one different lighting module every time (direct current measurement) or switch off one different lighting module every time (current calculation from the difference).

Figure 8G:
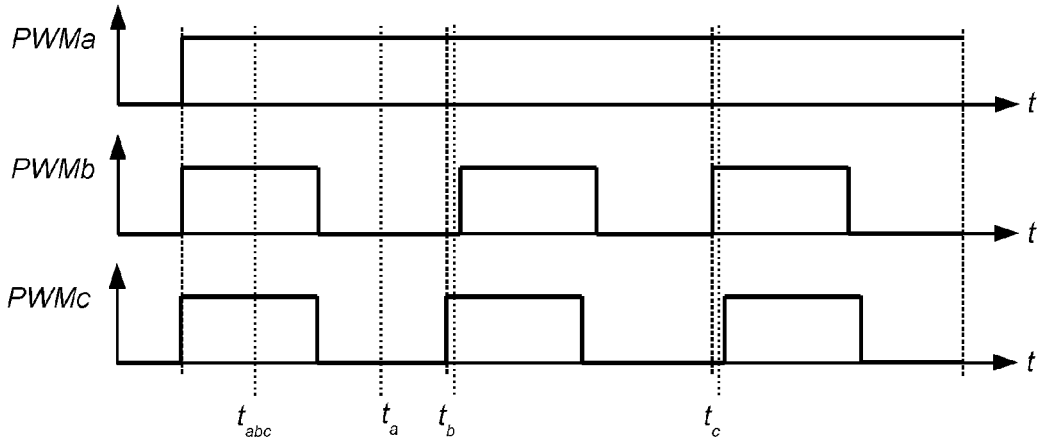

For example, FIG. 8G shows an embodiment wherein the current flowing through lighting module 20*a* is detected at time $t_a$, when only signal PWMa is high. On the other hand, the current flowing through lighting module 20*b* is detected at time $t_b$, when only signal PWMb is low. Finally, the current flowing through lighting module 20*c* may be calculated from the other measurements or may be detected at time $t_c$, when only signal PWMc is low.

Therefore, in the presently considered embodiments, control unit 102 takes advantage of the fact that the drive signals PWMa . . . PWMn are PWM signals.

Specifically, in various embodiments, the lighting system includes a single current sensor, adapted to detect the instantaneous current provided by voltage source 12. Therefore, said single current sensor 104, such as e.g. a shunt resistor $R_S$, enables the detection of the total current (i.e. the sum of the currents) of all lighting modules 20*a* . . . 20*c* which are connected to voltage source 12.

For example, when all drive signals PWMa . . . PWMn are high, the measured value is indicative of the total current. Therefore, in various embodiments, the control unit 102 synchronizes the drive signals PWMa . . . PWNn, so as to ensure that in specific instants all drive signals PWMa . . . PWMn are high. For example, in various embodiments the drive signals PWMa . . . PWMn are synchronized so that this condition is satisfied for every PWM cycle. For example, in various embodiments, control unit 102 sets all drive signals PWMa . . . PWMn simultaneously to high (synchronization of switching on) or to low (synchronization of switching off). As stated in the foregoing, in various embodiments this synchronization may optionally be valid only for the reference drive signals PWMa . . . PWMn, i.e. those signals normally used for the other PWM cycles.

On the other hand, in order to determine the currents flowing through the various lighting modules 20*a* . . . 20*c* during a sequence of one or more PWM cycles, control unit 102 modifies (advantageously only temporarily) the duty cycle of one or more drive signals PWMa . . . PWMn and/or delays (advantageously only temporarily) one or more drive signals PWMa . . . PWMn, so as to ensure that during a sequence of (n−1) instants, every time a different set of lighting modules (20*a* . . . 20*n*) is connected to voltage source 12. For example, control unit 102 may vary the drive signals during the sequence of (n−1) instants, so that each drive signal PWMa . . . PWMn is high/low at a given time, while all other drive signals PWMa . . . PWMn are low/high at the same time.

In various embodiments, the reference drive signals PWMa . . . PWMn are therefore substantially constant, and are determined as a function of a control signal CTRL, e.g. for a colour mixing and/or dimming function. On the other hand, the control unit adjusts (advantageously only temporarily, i.e. during a sequence of some PWM cycles) the drive signals PWMa . . . PWMn in order to enable an individual measurement of the current flowing through each lighting module 20*a* . . . 20*c*.

Generally speaking, the presently described solution may be also used when the duty cycle amounts to 100%. Indeed, in this case, too, control unit 102 may temporarily reduce the duty cycles, so that during a sequence of PWM cycles each drive signal PWMa . . . PWMn is high in a given instant, while all other drive signals PWMa . . . PWMn are low in that instant.

The control unit 102 is therefore adapted to detect the total current and the contribution of each single lighting module through one single measurement channel, e.g. through one single analog-to-digital converter. On the basis of these data, therefore, control unit 102 may calculate the absorbed power (PWR signal) and/or determine a failure or disconnection of a lighting module (signal ERR).

In the presently considered embodiments, the switches SAa . . . SWb are closed when the respective drive signal is high. However, the same principle may be applied also if the operation is inverted.

The presently described solutions offer therefore several advantages, such as for instance:

- it is sufficient to use one single current sensor 104, e.g. one single shunt resistor $R_S$;
- similarly, only one measurement channel is needed, including e.g. an analog-to-digital converter and optionally filters;
- the measurement is instantaneous, and therefore more accurate than other measurements, e.g. based on the measure of the average current, especially at low dimming levels;
- the control unit 102 may measure the current also when all lighting modules are off, which enables detecting failures or implementing a calibration (e.g. a zero reset) of the measurement channel.

Of course, without prejudice to the principle of the present disclosure, the details and the embodiments may vary, even appreciably, with respect to what has been described herein by way of non-limiting example only, without departing from the extent of protection of the present disclosure as defined by the annexed claims.

While the disclosed embodiments have been particularly shown and described with reference to specific embodiments, it should be understood by those skilled in the art that various changes in form and detail may be made therein without departing from the spirit and scope of the disclosed embodiments as defined by the appended claims. The scope of the disclosed embodiments is thus indicated by the appended claims and all changes which come within the meaning and range of equivalency of the claims are therefore intended to be embraced.

The invention claimed is:

1. Lighting system comprising:

a voltage source configured to generate a constant direct current adapted to supply a plurality of lighting modules;

a number n of electronic switches, wherein each electronic switch is configured to connect a respective lighting module to said voltage source as a function of a respective drive signal;

a current sensor connected in series with said voltage source in order to detect a measurement signal indicative of the current provided by said voltage source; and a control unit configured for:

a) generating said drive signals for said plurality of electronic switches, b) varying said drive signals, such that:

in a first instant, all lighting modules are connected to said voltage source; and during a sequence of instants, each time a different set of lighting modules is connected to said voltage source;

c) determining the current flowing through all lighting modules as a function of said measurement signal detected in said first instant, and d) determining the currents which flow through the respective lighting modules as a function the measurement signals detected during said sequence of instants.

2. Lighting system according to claim 1, wherein said drive signals are Pulse Width Modulation signals having a given period and a given switch-on duration, wherein said control unit determines the switch-on duration of each drive signal as a function of one or more control signals.

3. Lighting system according to claim 2, wherein said control unit determines the switch-on duration of each drive signal in order to implement a color correction and/or dimming operation.

4. Lighting system according to claim 2, wherein said period is equal for all drive signals, and wherein said varying said drive signals comprises at least one of:

delaying one or more of said drive signals; and/or modifying the switch-on duration of one or more of said drive signals.

5. Lighting system according to claim 4, wherein said control unit is configured for varying said drive signals only temporarily.

6. Lighting system according to claim 1, comprising a plurality of lighting modules connected between said voltage source and said plurality of electronic switches.

7. Lighting system according to claim 6, wherein said voltage source comprises a positive terminal and a negative terminal, wherein each lighting module is connected on one side to said positive terminal of said voltage source and on the other side through a respective electronic switch to said negative terminal of said voltage source.

8. Lighting system according to claim 7, wherein said current sensor is connected between said negative terminal of said voltage source and said plurality of electronic switches.

9. Lighting system according to claim 1, wherein said current sensor is a shunt resistor ($R_S$).

10. Lighting system according to claim 1, wherein said control unit is configured for:

determining a signal indicative of absorbed power as a function of said current flowing through all lighting modules, and/or determining one or more signals indicative of an error or fault as a function of said currents flowing through the respective lighting modules.

11. Method of operating a lighting system, wherein the system comprises, a voltage source configured to generate a constant direct current adapted to supply a plurality of lighting modules;

a number n of electronic switches, wherein each electronic switch is configured to connect a respective lighting module to said voltage source as a function of a respective drive signal;

a current sensor connected in series with said voltage source in order to detect a measurement signal indicative of the current provided by said voltage source; and a control unit;

the method comprising executing the following steps in said control unit:

a) generating said drive signals for said plurality of electronic switches, b) varying said drive signals, such that:

in a first instant, all lighting modules are connected to said voltage source; and during a sequence of instants, each time a different set of lighting modules is connected to said voltage source;

c) determining the current flowing through all lighting modules as a function of said measurement signal detected in said first instant, and d) determining the currents flowing through the respective lighting modules as a function of the measurement signals detected during said sequence of instants.

* * * * *